US012578162B2

(12) United States Patent
Liao

(10) Patent No.: US 12,578,162 B2
(45) Date of Patent: Mar. 17, 2026

(54) ADJUSTING DEVICE OF TOY GUN

(71) Applicant: GUAY GUAY TRADING CO., LTD., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 136 days.

(21) Appl. No.: 18/493,766

(22) Filed: Oct. 24, 2023

(65) Prior Publication Data

US 2025/0044055 A1 Feb. 6, 2025

(30) Foreign Application Priority Data

Aug. 4, 2023 (TW) ..... 112208255

(51) Int. Cl.
*F41B 11/70* (2013.01)
*F41B 11/89* (2013.01)
*F42B 10/26* (2006.01)

(52) U.S. Cl.
CPC ..... *F41B 11/70* (2013.01); *F41B 11/89* (2013.01); *F42B 10/26* (2013.01)

(58) Field of Classification Search
CPC ..... F41B 11/70; F41B 11/89; F41B 10/26; F41A 21/12; F41A 21/04
USPC ..... 124/81
See application file for complete search history.

(56) References Cited

U.S. PATENT DOCUMENTS 2,182,369 A * 12/1939 Barron ..... A63B 69/409 124/81
5,655,510 A * 8/1997 Kunimoto ..... F41B 11/00 124/81
9,103,624 B1 * 8/2015 Kung ..... F41B 11/62
9,541,346 B1 * 1/2017 Huang ..... F42B 10/26
10,837,730 B1 * 11/2020 Hu ..... F41A 21/12
2005/0178877 A1 * 8/2005 Marsac ..... F41A 21/02 244/3.21
2012/0272941 A1 * 11/2012 Hu ..... F41A 21/10 124/83
2015/0059721 A1 * 3/2015 Huang ..... F41B 7/08 124/27
2016/0116244 A1 * 4/2016 Zou ..... F41B 7/08 124/83

(Continued)

*Primary Examiner* — John E Simms, Jr.
(74) *Attorney, Agent, or Firm* — Birch, Stewart, Kolasch & Birch, LLP

(57) ABSTRACT

An adjusting device of a toy gun includes a contacting element, a down-pressing controlling member, an adjusting wheel, a guide groove, a driving portion, a mating portion, an adjusting screw, a positioning block, a number of positioning facets, and an elastic positioning member. The adjusting screw drives the adjusting wheel to rotate by means of the mating portion to make the guide groove of the adjusting wheel towing the driving portion of the down-pressing controlling member to pull the down-pressing controlling member downward to thereby adjust a compression degree that the down-pressing controlling member compresses the contacting element and thus adjusting an upward spinning force induced on the BB bullet. The adjusting screw uses a combination of the positioning block and the elastic positioning member to realize grade adjustment of a trajectory of the BB bullet according to the number of the positioning facets.

5 Claims, 12 Drawing Sheets

(56) References Cited

U.S. PATENT DOCUMENTS

| | | | | |
|---|---|---|---|---|
| 2019/0011217 | A1* | 1/2019 | Liao | F41B 11/70 |
| 2022/0082351 | A1* | 3/2022 | Liao | F41B 11/71 |

* cited by examiner

ADJUSTING DEVICE OF TOY GUN

BACKGROUND OF THE INVENTION

(a) Technical Field of the Invention

The present invention relates to an adjusting device of a toy gun that features a grade-adjustment function of an upward spinning force of a BB bullet, and excellent hand feeling of grade switching, and an easy-to-mount structure.

(b) Description of the Prior Art

A hop-up device uses aerodynamics to impart a forward-rotating force on a projectile in a gun barrel so that the projectile, after exiting the muzzle, creates a Magnus force to effectively increase the shooting range and stability of the projectile.

The hop-up devices are generally classified as fixed type and adjustable type. The adjustable type allows the hop-up device to change a pressing force applied to a projectile so as to provide the projectile with different rotating speeds after being shot. However, the adjustable type hop-up device has a relatively complicated structure, whether it is graded adjustment or grade-less adjustment, and further, projectiles produced by different manufacturers may not be applicable to the same hop-up device, and toy guns of different models may not accept the same hop-up device to mount thereon. In addition, due to the complicated structure, the hop-up device is often adopted in rifles that are of a relatively large size, and hand guns that are of a relatively small size cannot be mounted with such a device due to insufficiency of space and difficulty of avoiding internal essential parts, resulting in difficulty of modifying the toy guns by the hobbyists of the survival games.

SUMMARY OF THE INVENTION

In view of the above, the present invention aims to provide an adjusting device of a toy gun that features a grade-adjustment function of an upward spinning force of a BB bullet, and excellent hand feeling of grade switching, and an easy-to-mount structure.

The primary objective of the present invention is that a combined arrangement of an adjusting screw and an adjusting wheel is provided to make the spatial arrangement of the entire structure easy to change so as to be suitable for a toy gun in the form of a hand gun that has a relatively small size.

Another objective of the present invention is that an arrangement of a positioning block and an elastic positioning member is provided to provide an operation of adjusting an upward spinning force among various grades with better hand feeling of operation and the number of grades among which the adjustment can be made is determined according to the number of positioning facets 51.

To achieve the above objectives, the present invention provides a toy gun that comprises a barrel portion, and an adjusting device that mainly comprises: a contacting element, a down-pressing controlling member, an adjusting wheel, at least one guide groove, at least one driving portion, a mating portion, an adjusting screw, a positioning block, at least three positioning facets, and an elastic positioning member. In the adjusting device, the contacting element is attached to a side of the barrel portion to contact a BB bullet to generate an upward spinning force; the down-pressing controlling member is arranged on the contacting element to control a degree of contacting of the contacting element; the adjusting wheel is arranged on one side of the down-pressing controlling member; the guide groove is formed, in a circumferentially extending manner, on a side surface of the adjusting wheel, the guide groove being arranged to reduce a distance thereof from an axis center of the adjusting wheel in a direction of extension thereof; the driving portion is disposed on one side of the down-pressing controlling member and is arranged in the guide groove to drive the down-pressing controlling member to move; the mating portion is formed in a lateral edge of the adjusting wheel; the adjusting screw is arranged at one side of the adjusting wheel and correspondingly mates with the mating portion to drive the adjusting wheel to rotate; the positioning block is combined with the adjusting screw; the positioning facets are formed on a lateral of the positioning block, such that the positioning block is formed in a multiple-sided configuration; and the elastic positioning member is arranged at one side of the positioning block to contact at least one of the positioning facets to fix and hold the adjusting screw at a corresponding angle.

When a user uses the present invention to adjust the trajectory of a BB bullet, the operation is performed by rotating the adjusting screw, so as to make the adjusting screw driving the adjusting wheel to rotate by means of the mating portion, while the driving portion of the down-pressing controlling member is set in the guide groove of the adjusting wheel, and the guide groove is arranged to have a distance thereof from the axis center of the adjusting wheel gradually reduced in the direction of extension thereof, so that the rotation of the adjusting wheel makes the guide groove towing the driving portion of the down-pressing controlling member to move in such a way as to pull the down-pressing controlling member to move downward to thereby adjust a compression degree of the down-pressing controlling member compressing the contacting element and thus adjusting the upward spinning force induced on the BB bullet. Particularly, the adjusting screw makes use of a combination of the positioning block and the elastic positioning member, while the positioning block is of a multiple-sided configuration, so that rotating the adjusting screw causes the elastic positioning member to abut against at least one of the positioning facets, and adjustment of the trajectory of the BB bullet among various grades is realized with such an abutting effect and a clear hand feeling of grade switching is achieved with such a spring force so as to make the overall operation smooth and easy.

Based on the above technology, the shortcomings of the prior art that the structure of the known toy gun hop-up device is complicated and is not applicable to different models or specifications of the toy gun, and is not easy to modify for mounting to the toy gun can be overcome, and practical utilization having the above-discussed advantages can thus be achieved.

DETAILED DESCRIPTION OF THE PREFERRED EMBODIMENTS

Figure 1:
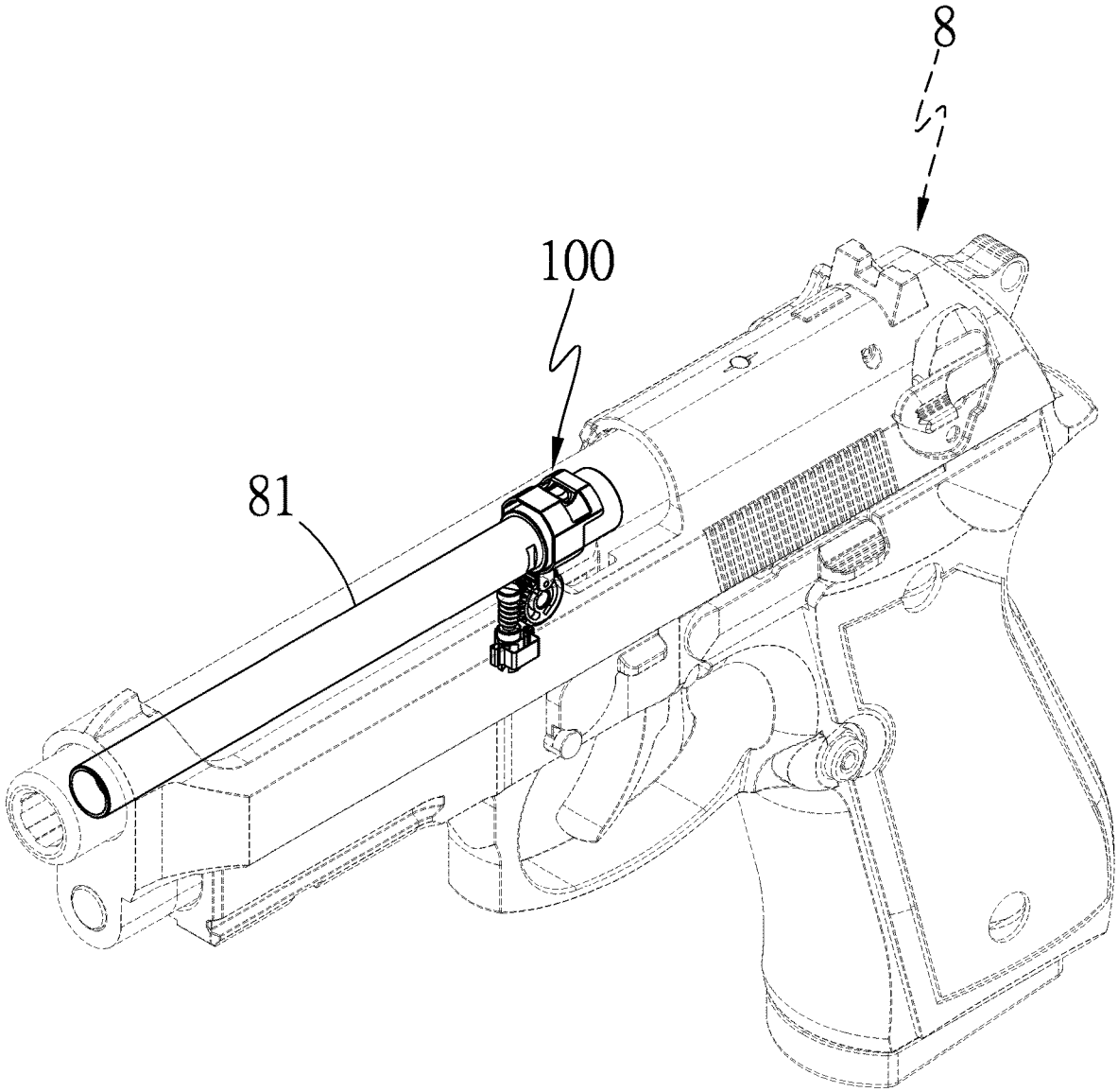
FIG. 1 is a perspective view, in a see-through form, showing a preferred embodiment of the present invention.
Figure 2:
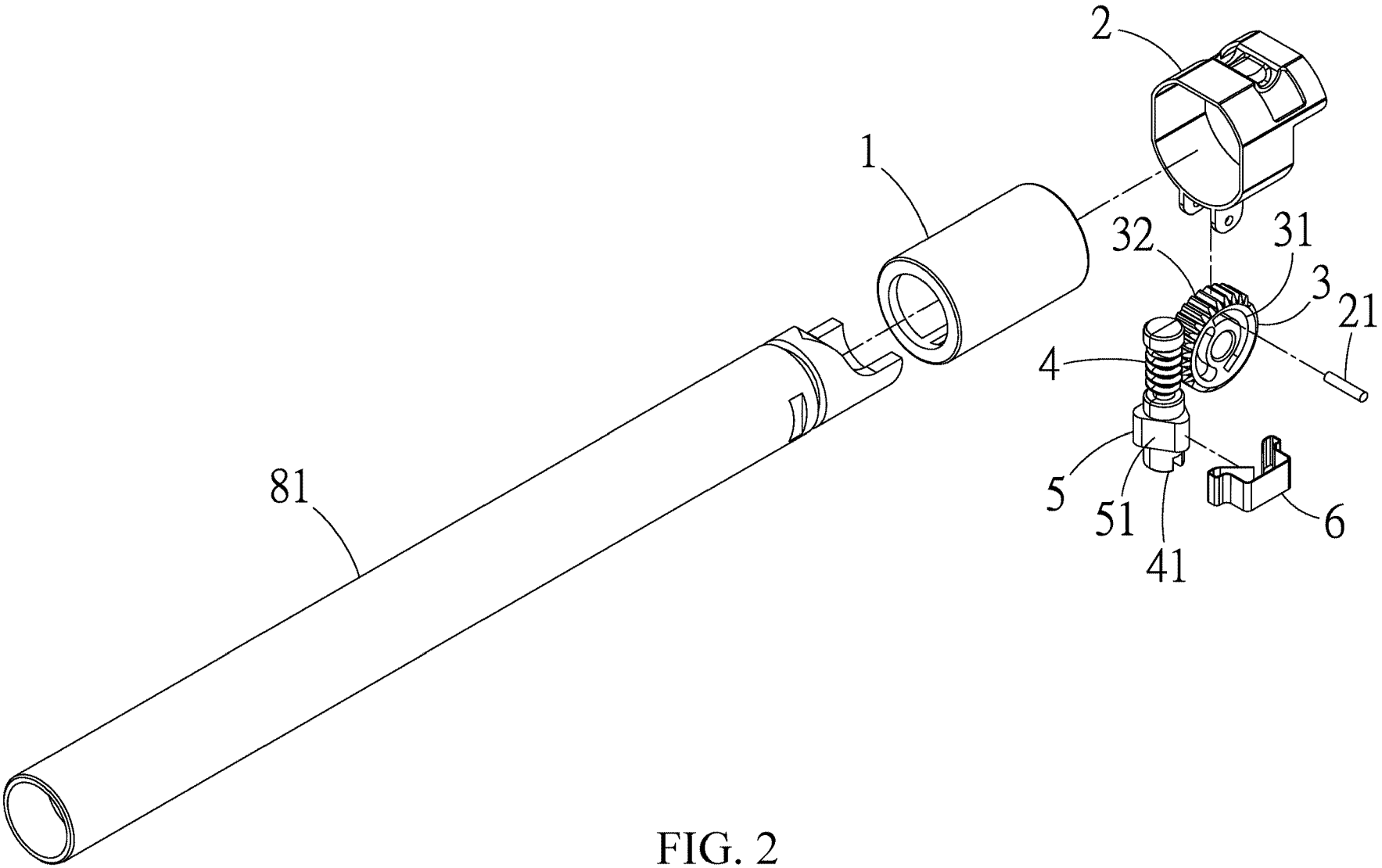
FIG. 2 is an exploded view of a hidden toy gun of the preferred embodiment of the present invention.
Figure 3:
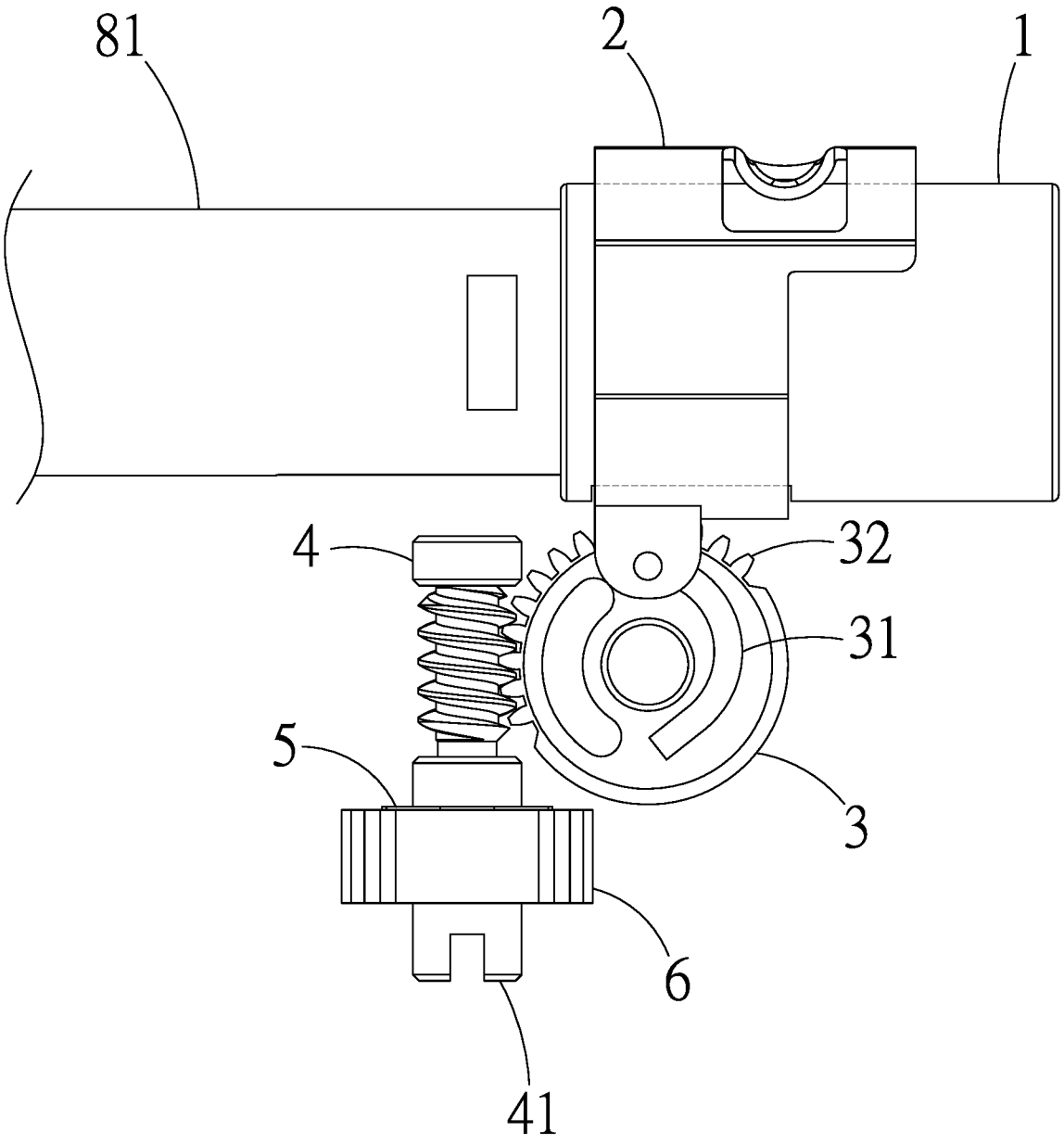
FIG. 3 is a plan view of the hidden toy gun of the preferred embodiment of the present invention.
Figure 4:
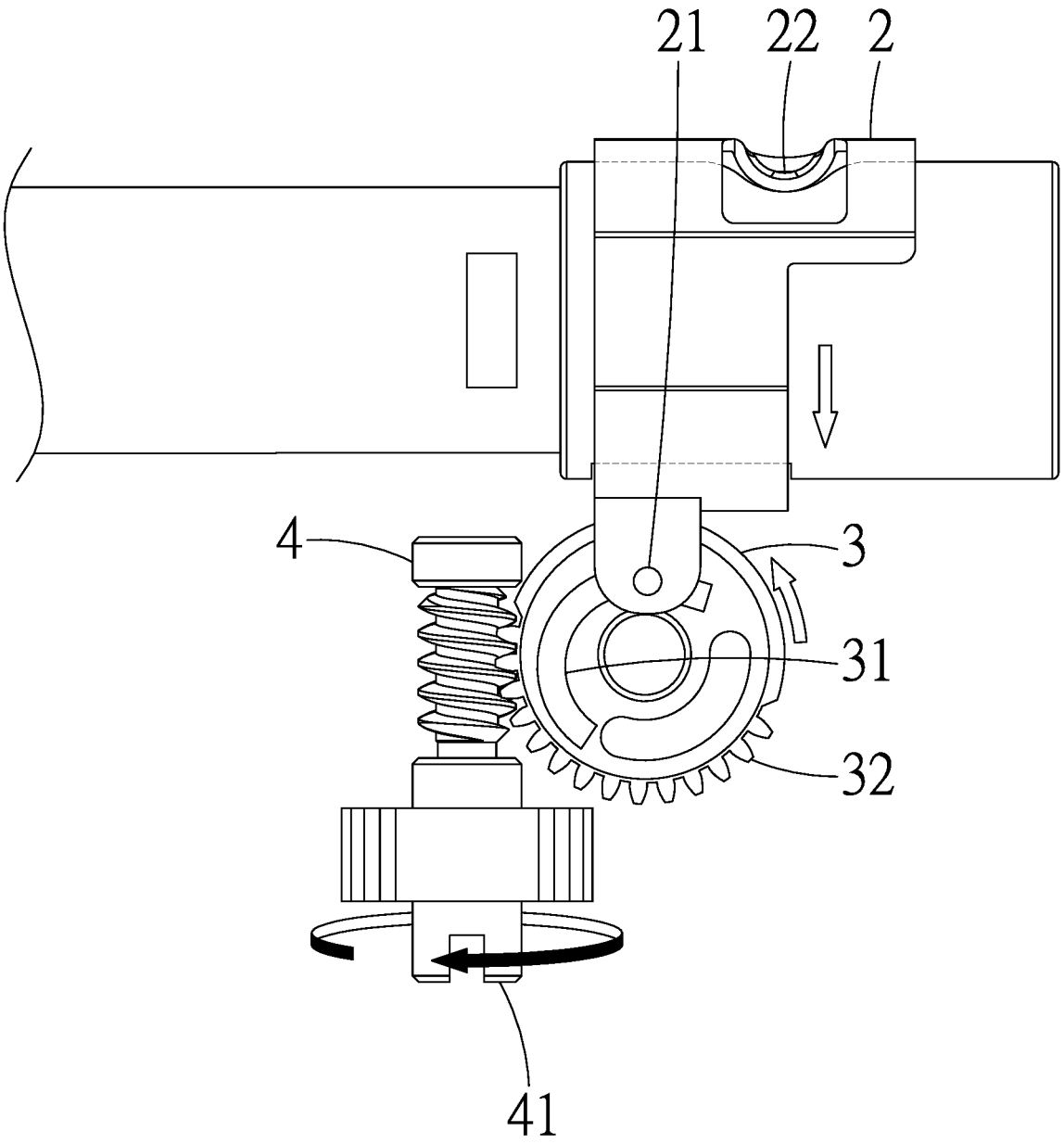
FIG. 4 is a schematic view illustrating adjusting of the present invention of the present invention.
Figure 5:
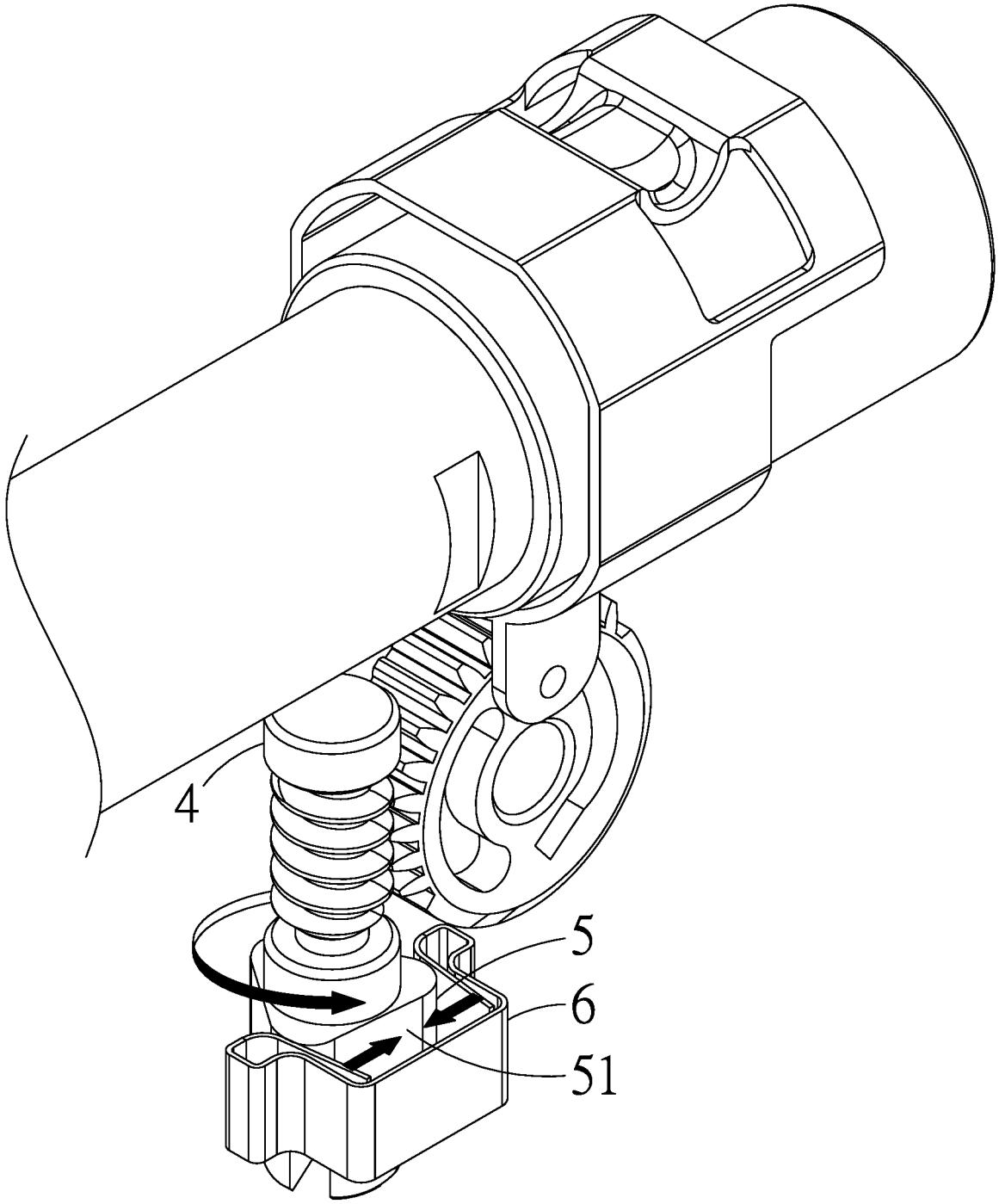
FIG. 5 is a schematic view illustrating grading of the present invention of the present invention.
Figure 6:
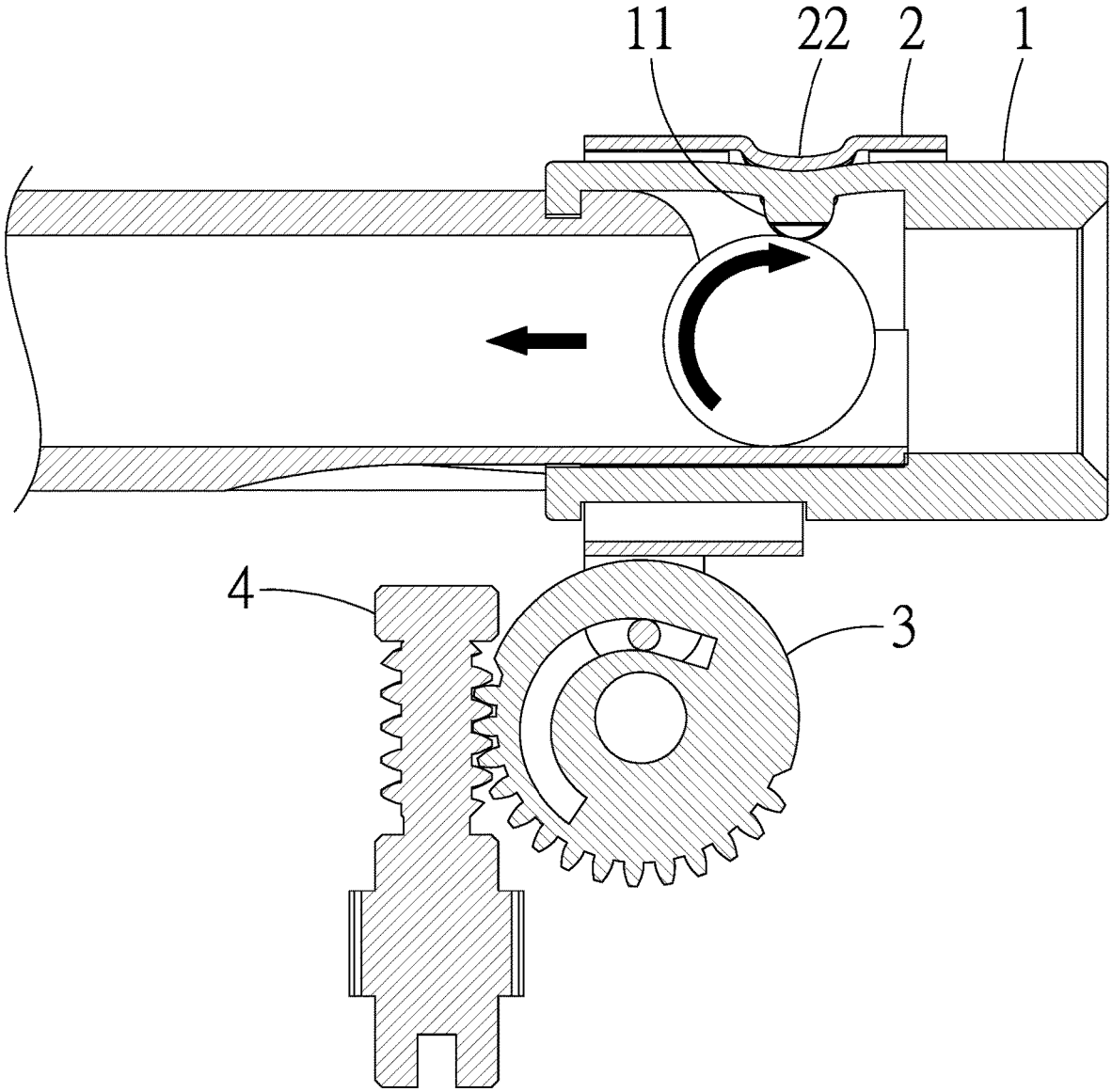
FIG. 6 is a schematic view illustrating upward-spinning of the present invention of the present invention.

Referring to FIGS. 1-3, which are a perspective view, in a see-through form, showing a preferred embodiment of the present invention to a plan view of a hidden toy gun of the preferred embodiment of the present invention, it is clearly seen from the drawings that a toy gun 8 of the present invention comprises a barrel portion 81, and an adjusting device 100 mainly comprises:

- a contacting element 1, which is attached to a side of the barrel portion 81 to contact a BB bullet to generate an upward spinning force;
- a down-pressing controlling member 2, which is arranged on the contacting element 1 to control a degree of contacting of the contacting element 1;
- an adjusting wheel 3, which is arranged on one side of the down-pressing controlling member 2;
- at least one guide groove 31, which is formed, in a circumferentially extending manner, on a side surface of the adjusting wheel 3, the guide groove 31 being arranged to reduce a distance thereof from an axis center of the adjusting wheel 3 in a direction of extension thereof;
- at least one driving portion 21, which is disposed on one side of the down-pressing controlling member 2 and is arranged in the guide groove 31 to drive the down-pressing controlling member 2 to move;
- a mating portion 32, which is formed in a lateral edge of the adjusting wheel 3;
- an adjusting screw 4, which is arranged at one side of the adjusting wheel 3 and correspondingly mates with the mating portion 32 to drive the adjusting wheel 3 to rotate, wherein the adjusting screw 4 is provided, on one end thereof, with an operating portion 41 to allow a user to manually operate the adjusting screw 4;
- a positioning block 5, which is combined with the adjusting screw 4;
- at least three positioning facets 51, which are formed on a lateral of the positioning block 5, such that the positioning block 5 is formed in a multiple-sided configuration; and
- an elastic positioning member 6, which is arranged at one side of the positioning block 5 to contact at least one of the positioning facets 51 to fix and hold the adjusting screw 4 at a corresponding angle.

The above description provides an understanding to the structure of the technique, and based on a corresponding collaboration of such a structure, advantages associated with a grade-adjustment function of an upward spinning force of a BB bullet, and excellent hand feeling of grade switching, and an easy-to-mount structure can be realized. A detailed explanation will be provided below.

Referring simultaneously to FIGS. 1-6, which are a perspective view, in a see-through form, showing a preferred embodiment of the present invention to a schematic view illustrating upward-spinning of the present invention of the present invention, with the above components properly assembled, it is clearly seen from the drawings that the contacting element 1 is a hollow cylindrical rubber structure having an inner side on which a semi-circular inward protrusion portion 11 is formed at a location corresponding to a moving path of the BB bullet for generating friction on the BB bullet. The down-pressing controlling member 2 is a ring-like plate and is fit around outside of the contacting element 1 and is provided, on an inside thereof, with an arc or curved compressing portion 22 at a location corresponding to the inward protrusion portion 1. The adjusting wheel 3 is made in the form of a toothed wheel having an edge in which the mating portion 32 is formed. The guide groove 31 is formed as being extended at one side of the axis center of the adjusting wheel 3, and the guide groove 31 is made as a penetrating arrangement or in the form of a trough, and in the instant embodiment, a penetrating arrangement is taken as an example for illustration, and as such, the driving portion 21 is made in the form of a pin extending through the guide groove 31. The screw pitch of the adjusting screw 4 is identical to the tooth pitch of the mating portion 32. The positioning block 5 is of a multiple-sided structure that includes at least three side surfaces (which define the positioning facets 51), and in the instant embodiment, a triangle is taken as an example for illustration, and the way of combination between the positioning block 5 and the adjusting screw 4 can be externally attaching or integrally forming, and in the instant embodiment, the combination is made through integrally forming. The elastic positioning member 6 is formed by bending or curving an integrally formed metal plate and has a portion in contact with the positioning facets 51 to serve as a portion for primarily providing a sprig force. The corresponding configurations or forms of the above-described elements are provided as an example for a preferred embodiment and configurations or forms including similar functionality are considered belonging to the scope of the present invention, not just limiting to the examples listed above.

Operation is performed by rotating the adjusting screw 4, so as to make the adjusting screw 4 driving the adjusting wheel 3 to rotate by means of the mating portion 32, such as using a tool connected with the operating portion 41 to performing the rotating, while the driving portion 21 of the down-pressing controlling member 2 is set in the guide groove 31 of the adjusting wheel 3. As the guide groove 31 is arranged to have a distance thereof from the axis center of the adjusting wheel 3 gradually reduced in the direction of extension thereof, during the process of rotating of the adjusting wheel 3, the distance between the driving portion 21 and the axis center of the adjusting wheel 3 is gradually reduced (comparing FIG. 3, which shows a state before rotating and FIG. 4, which shows a state after rotating), meaning rotating the adjusting wheel 3 makes the guide groove 31 towing the driving portion 21 of the down-pressing controlling member 2 to move in such a way as to pull the down-pressing controlling member 2 to move downward to thereby adjust the down-pressing controlling member 2 to compress on the contacting element 1 and thus adjusting the upward spinning force induced on the BB bullet. The arrangement of the compressing portion 22 and the inward protrusion portion 11 allows a small amount of downward movement of the down-pressing controlling member 2 to cause a relatively large amount of inward protruding on the contacting element 1 thereby eliminating the need for requiring a relatively large size of the adjusting wheel 3 and a relatively great length of the adjusting screw 4, so that structure is simplified and size is reduced. Further, combination of the positioning block 5 and the elastic positioning member 6 provides switchability of the adjusting screw 4 among multiple grades or levels. Due to the multiple-sided configuration of the positioning block 5, rotating the adjusting screw 4 causes the elastic positioning member 6 to abut against at least one of the positioning facets 51, and in the instant embodiment, the elastic positioning member 6 being made to simultaneously abut against two of the positioning facets 51 is taken as an example for illustration, wherein such an arrangement of elastic clamping provides a strengthened effect of positioning that helps prevent the positioning block 5 from undesired positional shifting, while the abutting effect of the elastic positioning member 6 realizes adjustment of a BB bullet trajectory among various grades or levels. The spring force of the elastic positioning member 6 provides a clear and remarkable hand feeling of grade switching, making the entire operation smoother and easier. Further, the present invention realizes trajectory adjustment by means of the combination of the adjusting screw 4, the adjusting wheel 3, and the down-pressing controlling member 2, and the positional arrangement among the three has a great flexibility, making it possible to achieve a desired arrangement by using an idle space of the interior of the toy gun 8, such as changing the length of the adjusting screw 4 to adjust the positional relationship of the adjusting wheel 3, in an up-down direction, with respect to one side of the adjusting screw 4, or changing an axial length of the down-pressing controlling member 2 to adjust the positional relationship of the adjusting wheel 3, in a front-rear direction, with respect to one side of the down-pressing controlling member 2. The great flexibility of positional arrangement among the adjusting screw 4, the adjusting wheel 3, and the down-pressing controlling member 2 make it possible to fully exploit the internal idle space of the toy gun 8, particularly for being applicable to a toy gun 8 that is small in size.

Figure 7:
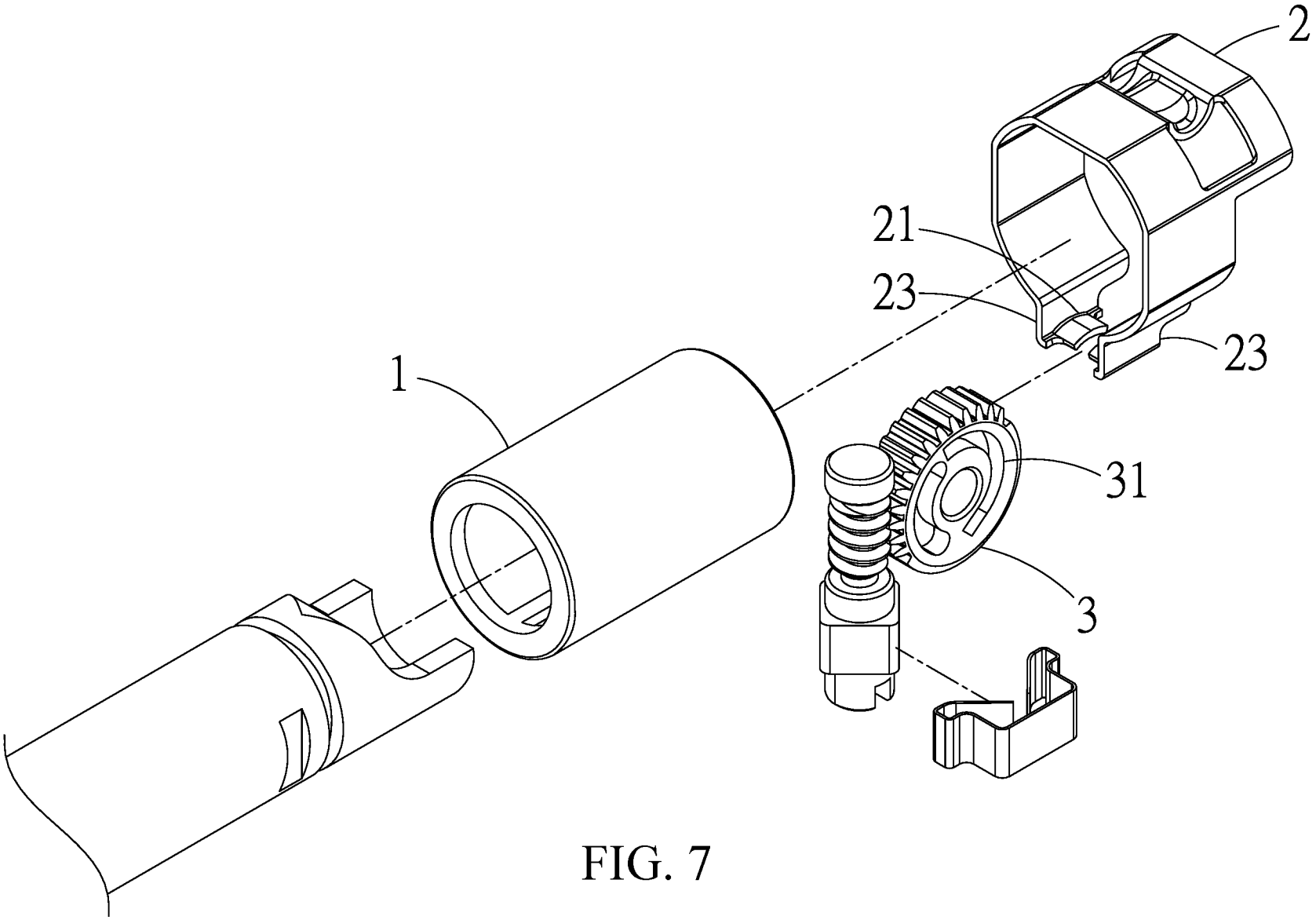
FIG. 7 is an exploded view of a hidden toy gun of another preferred embodiment of the present invention.
Figure 8:
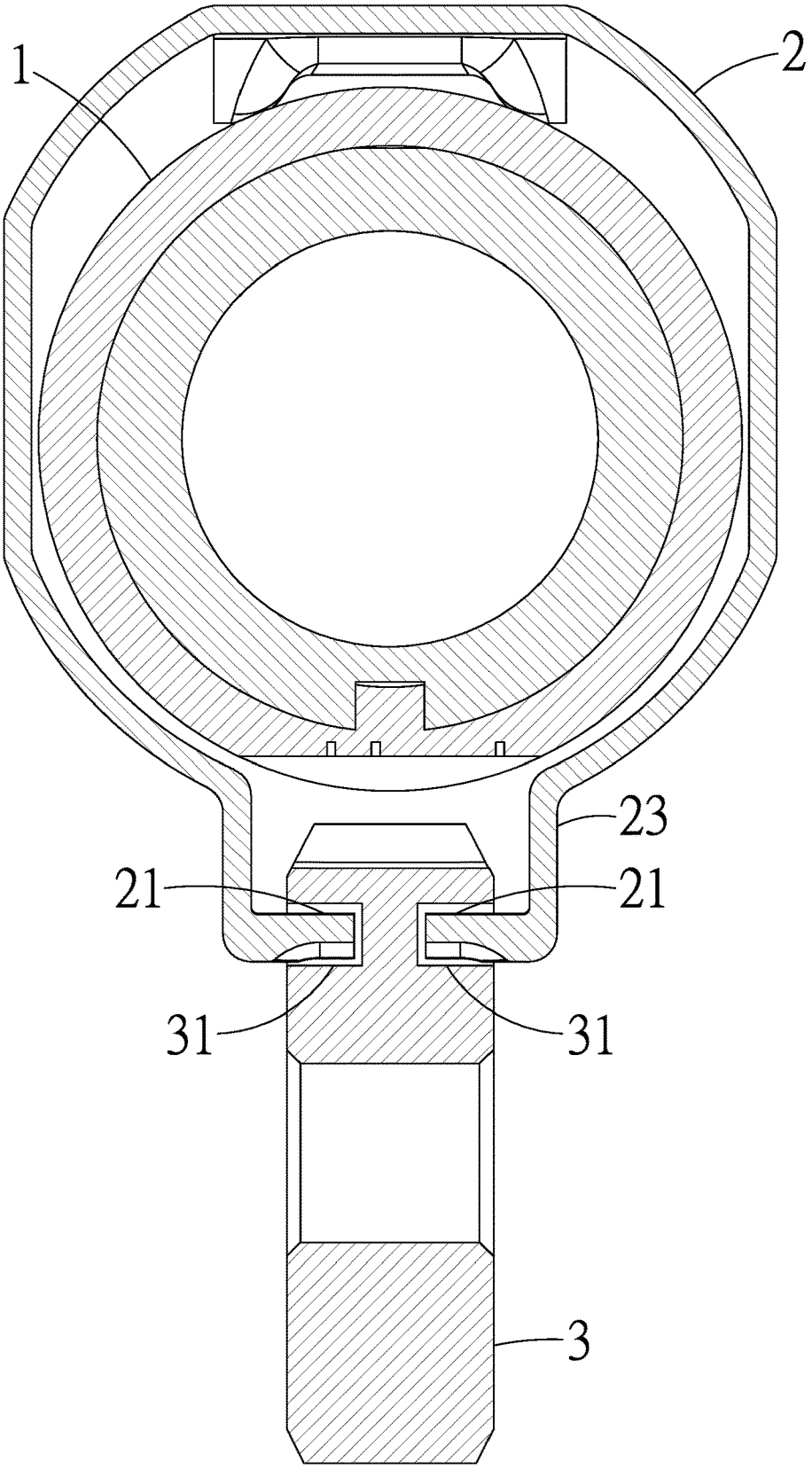
FIG. 8 is a cross-sectional view of the hidden toy gun of said another preferred embodiment of the present invention.

Referring also to FIGS. 7 and 8, which are an exploded view and a cross-sectional view of a hidden toy gun according to another preferred embodiment of the present invention, it is clearly seen from the drawings that the instant embodiment is generally similar to the previous embodiment, except that the down-pressing controlling member 2 is provided with two elastic arms 23 for clamping and holding the contacting element 1, and the driving portion 21 is formed on ends of the elastic arms 23, and the number of the guide groove 31 of the adjusting wheel 3 is increased to two and the two guide grooves that are made in the form of troughs respectively arranged on left and right side surfaces of the adjusting wheel 3. In this way, the outside appearance of the down-pressing controlling member 2 is generally of a C-shape, and the driving portion 21 is made in the form of two hooks respectively and integrally formed on the ends of the elastic arms 23 to apply the spring force of the elastic arms 23 to clamp and hold the contacting element 1 to similarly makes the adjusting wheel 3 towing and driving the down-pressing controlling member 2 to move, while the cost of the fixing structure (the pin) is saved and the size and weight of the down-pressing controlling member 2 are reduced. The operation of mounting is made easy as the fixing structure is omitted.

Figure 9:
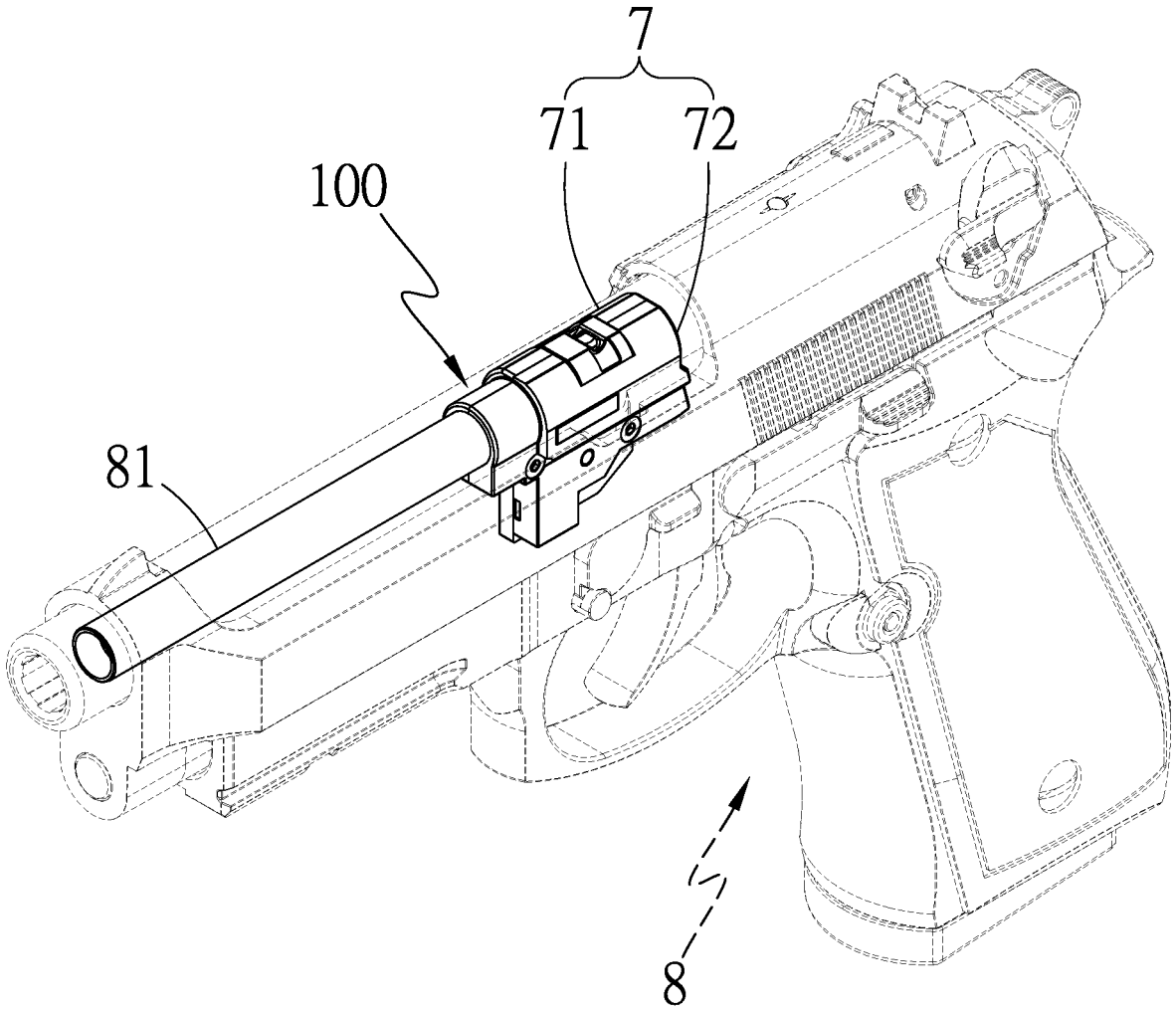
FIG. 9 is a perspective view, in a see-through form, showing a further preferred embodiment of the present invention.
Figure 10:
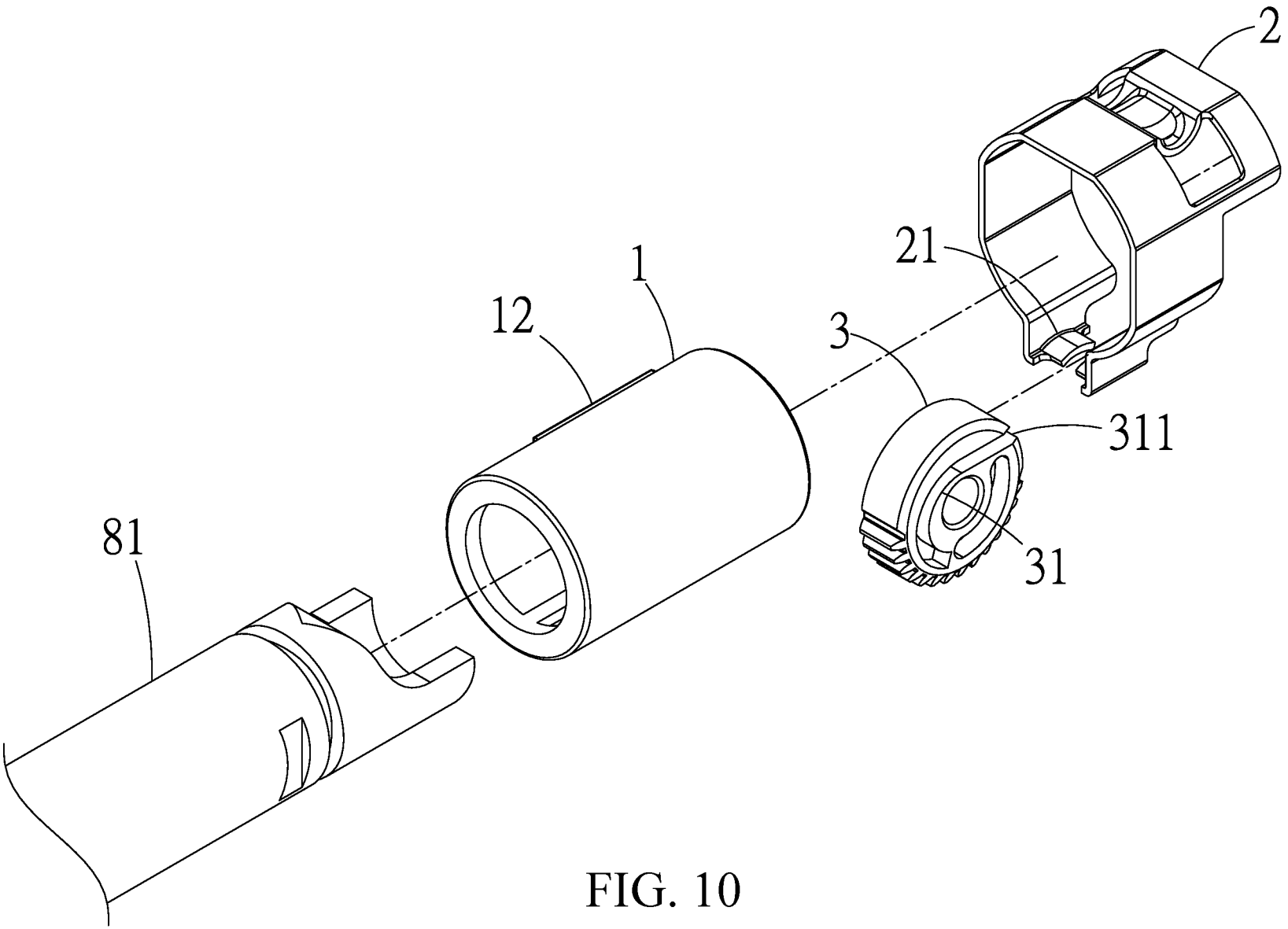
FIG. 10 is a schematic view illustrating assembling of said further preferred embodiment of the present invention.
Figure 11:
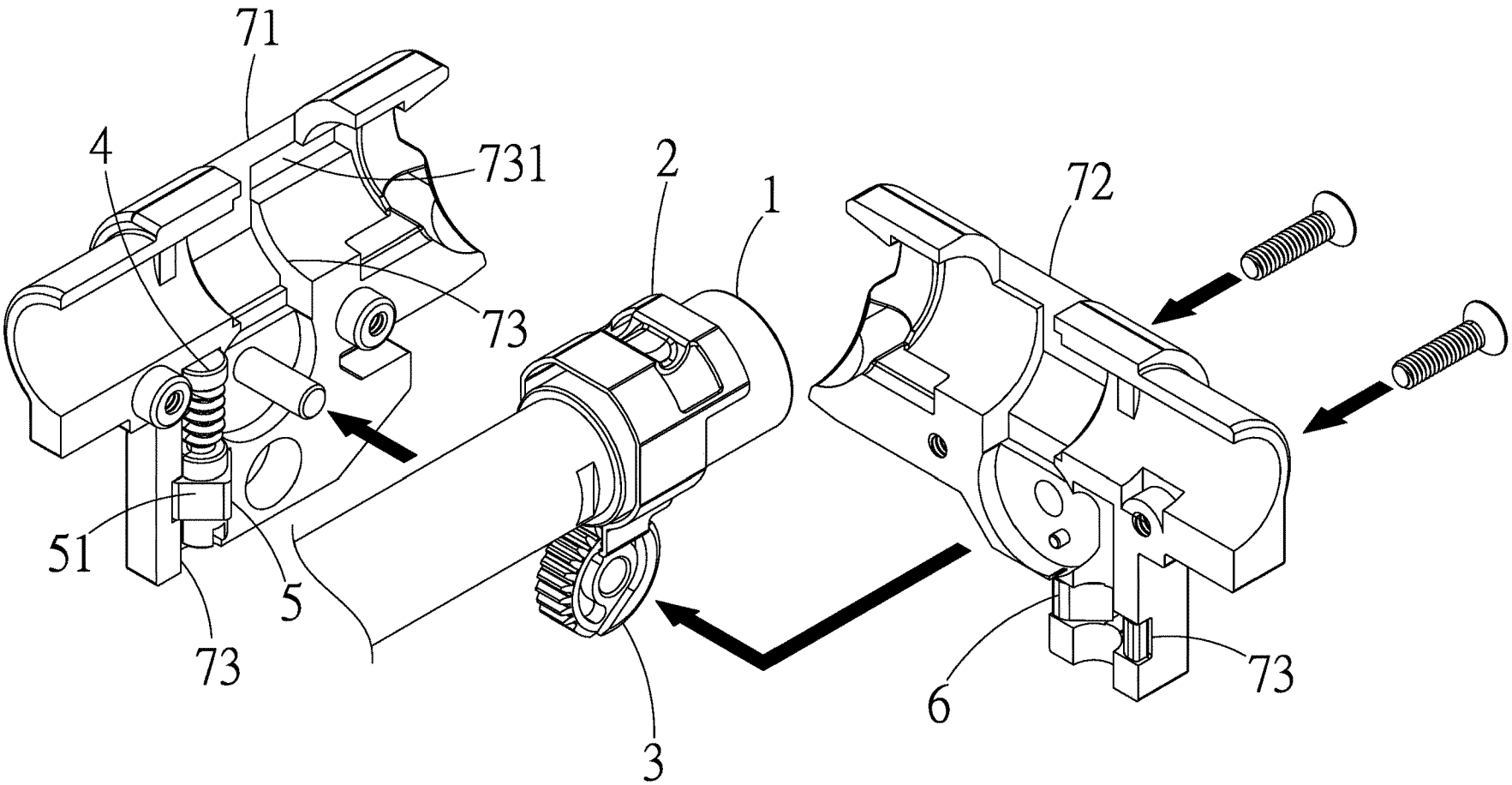
FIG. 11 is another schematic view illustrating assembling of said further preferred embodiment of the present invention.

Referring also to FIGS. 9-11, which are a perspective view, in a see-through form, showing a further preferred embodiment of the present invention to another schematic view illustrating assembling of said further preferred embodiment of the present invention, it is clearly seen from the drawings that the instant embodiment is generally similar to the previous embodiment, except that an opening portion 311 is formed at an end of the guide groove 31, and the opening portion 311 is in communication with the guide groove 31 and is formed on an outer circumference of the adjusting wheel 3. The toy gun 8 is provided, in an interior thereof, with a mounting seat 7 connected with the barrel portion 81, and in the instant embodiment, the mounting seat 7 is formed of a right-side seat body 71 and a left-side seat body 72. The mounting seat 7 includes a plurality of receiving portions 73 for mounting the adjusting device 100, meaning each component is provided with a corresponding receiving space, and the contacting element 1 is protruded from one side to form a positioning projection 12, and one of the receiving portions 73 that corresponds to the contacting element 1 is provided, in the interior thereof, with a joining portion 731 for holding and fixing the contacting element 1, and in the instant embodiment, a rectangular block protruding from a side surface of the contacting element 1 is taken as an example of the positioning projection 12 for illustration, and a through hole formed in the receiving portion 73 is taken as an example of the joining portion 731. Further, in the instant embodiment, the number of the positioning facets 51 is increased to four, so that the outside appearance of the positioning block 5 becomes a square that provides a function of adjustment for four grades or levels. With the above-described structure, difficulty of mounting the adjusting device 100 to the toy gun 8 is reduced. Specifically, the mounting operation is to first combine the contacting element 1 with the barrel portion 81, and to then move the driving portion 21 of the down-pressing controlling member 2 through the opening portion 311 of the adjusting wheel 3 to get into the guide groove 31 to thus fit the down-pressing controlling member 2 to outside of the contacting element 1, and subsequently, placing the adjusting screw 4 in a corresponding one of the receiving portion 73 on the right-side seat body 71 (in FIG. 11, a right half of the positioning block 5 being already received in the receiving portion 73, with only two of the positioning facets 51 exposed), and disposing the elastic positioning member 6 in a corresponding one of the receiving portions 73 on the left-side seat body 72, and finally, during an operation of combining the right-side seat body 71 and the left-side seat body 72 together, having the positioning projection 12 of the contacting element 1 mounted in the joining portion 731 to help position the contacting element 1, the down-pressing controlling member 2, and the adjusting wheel 3 with respect to the right-side seat body 71, and then, applying the left-side seat body 72 to enclose the contacting element 1, the down-pressing controlling member 2, the adjusting wheel 3, and a rear portion of the barrel portion 81 to form the adjusting device 100 in the form of a combined structure for easily mounting in the interior of the toy gun 8.

Figure 12:
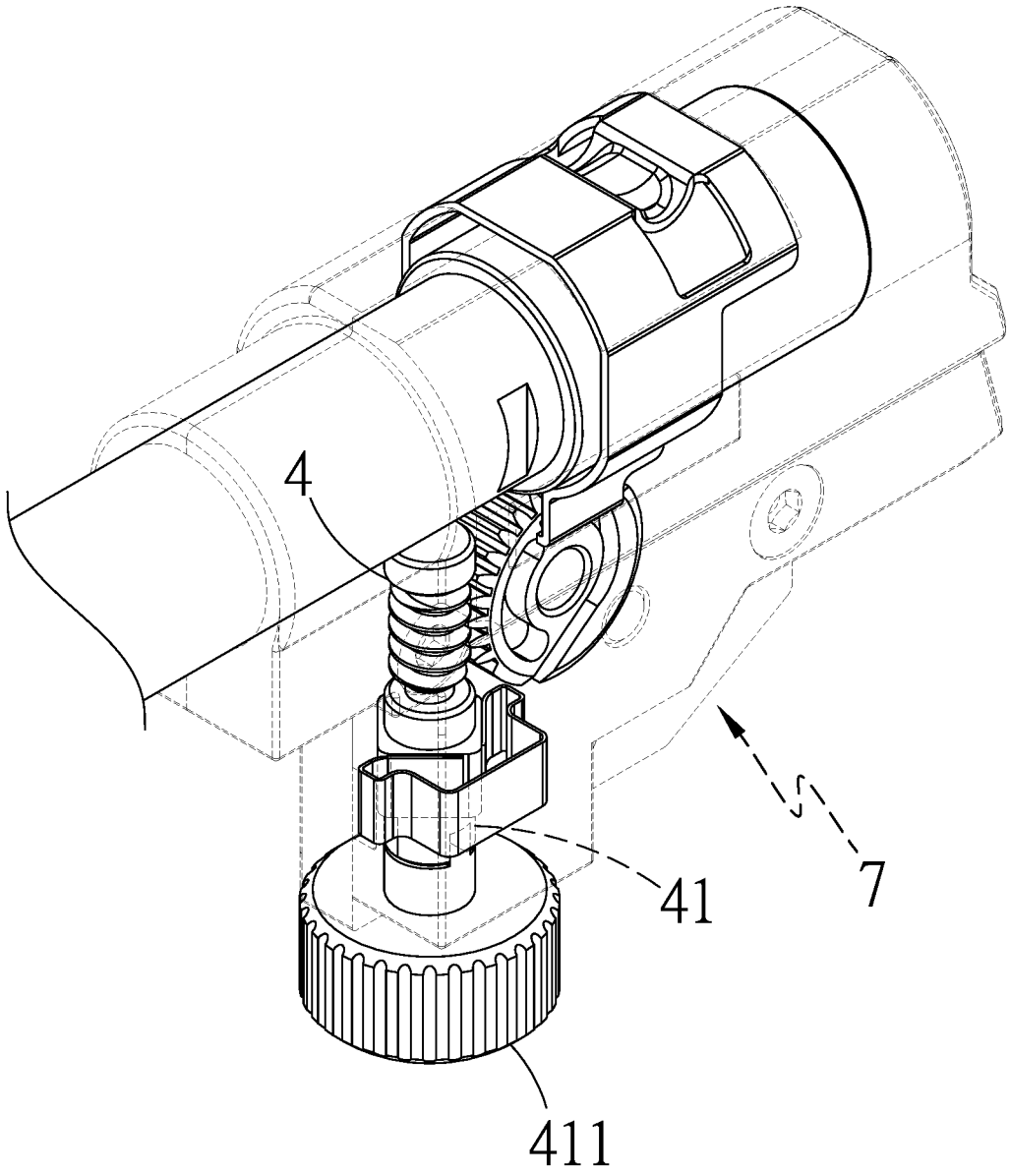
FIG. 12 is a schematic view illustrating use of yet a further preferred embodiment of the present invention.

Referring also to FIG. 12, which is a schematic view illustrating use of yet a further preferred embodiment of the present invention, it is clearly seen from the drawing that the instant embodiment is generally similar to the previous embodiment, except that the operating portion 41 is provided with an operating member 411 connected thereto and exposed outside of the toy gun, and in the instant embodiment, the operating member 411 is made in the form of a bolt head that can be normally fixed on the operating portion 41, or can alternatively be such that the operating member 411 is additionally attached to the operating portion 41 only when it is desired to make adjustment, so as to have the head end thereof abutting one side of the mounting seat 7, while a side surface of the head end is partly exposed outside of the toy gun for easy operation, wherein an adjusting direction of the operating member 411 is identical to a rotating direction of the adjusting screw 4, so that a user, when adjusting the trajectory, may clearly perceive the rotation of the adjusting screw 4 so as to facilitate improving the hand feeling of operation.

The above only provides description of the preferred embodiments of the present invention and is not intended to limit the scope of the claims of the present invention, and it is noted that easy modifications and equivalent structural variations that are made according to the specification and the drawings of the present invention similarly fall in the scope of the claims of the present invention.

Thus, the key technical points that the adjusting device 100 of the toy gun 8 according to the present invention may alleviate the drawbacks of the prior art are as follows:

Firstly, the combined arrangement of the adjusting screw 4 and the adjusting wheel 3 makes the spatial arrangement of the entire structure easy to change so as to be suitable for a toy gun 8 in the form of a hand gun that has a relatively small size.

Secondly, the arrangement of the positioning block 5 and the elastic positioning member 6 provides the operation of adjusting the upward spinning force among various grades with better hand feeling of operation and the number of grades among which the adjustment can be made is determined according to the number of the positioning facets 51.

Thirdly, clamping and holding the contacting element 1 by means of the spring force of the elastic arms 23 makes the operation of mounting easy and save the use of fixing structures (the pin).

Fourthly, the arrangement of the mounting seat 7, the receiving portions 73, and the opening portion 311 reduces the difficulty of mounting the adjusting device 100 to the toy gun 8.

Fifthly, the arrangement of the operating member 411 makes the operation of adjusting the trajectory easy and the adjusting direction of the operating member 411 is the same as the rotating direction of the adjusting screw 4, so that the user, when making an adjustment of the trajectory, may directly perceive the rotation of the adjusting screw 4 thereby facilitating enhancement of the hand feeling of operation.

Sixthly, the arrangement of the positioning projection 12 helps position the contacting element 1, the down-pressing controlling member 2, and the adjusting wheel 3 with respect to the right-side seat body 71 to thereby preventing components from falling during the course of mounting and thus making the mounting operation smoothly conducted.

I claim:

1. An adjusting device of a toy gun, the toy gun comprising a barrel portion, the adjusting device mainly comprising:

a contacting element, which is attached to a side of the barrel portion to contact a BB bullet to generate an upward spinning force;

a down-pressing controlling member, which is arranged on the contacting element to control a degree of contacting of the contacting element;

an adjusting wheel, which is arranged on one side of the down-pressing controlling member;

at least one guide groove, which is formed, in a circumferentially extending manner, on a side surface of the adjusting wheel, the guide groove being arranged to reduce a distance thereof from an axis center of the adjusting wheel in a direction of extension thereof;

at least one driving portion, which is disposed on one side of the down-pressing controlling member and is arranged in the guide groove to drive the down-pressing controlling member to move;

a mating portion, which is formed in a lateral edge of the adjusting wheel;

an adjusting screw, which is arranged at one side of the adjusting wheel and correspondingly mates with the mating portion to drive the adjusting wheel to rotate;

a positioning block, which is combined with the adjusting screw;

at least three positioning facets, which are formed on a lateral of the positioning block, such that the positioning block is formed in a multiple-sided configuration; and an elastic positioning member, which is arranged at one side of the positioning block to contact at least one of the positioning facets to fix and hold the adjusting screw at a corresponding angle.

2. The adjusting device of the toy gun according to claim 1, wherein an opening portion is formed at an end of the guide groove.

3. The adjusting device of the toy gun according to claim 1, wherein the adjusting screw is provided, on one end thereof, with an operating portion for a user to manually operate the adjusting screw.

4. The adjusting device of the toy gun according to claim 3, wherein an operating member is connected to the operating portion and is exposed outside of the toy gun.

5. The adjusting device of the toy gun according to claim 1, wherein the down-pressing controlling member is provided with two elastic arms for clamping and holding the contacting element, and the driving portion is formed on ends of the elastic arms.

* * * * *